United States Patent [19]

Vucinic

[11] 4,239,446

[45] Dec. 16, 1980

[54] ADAPTER FOR A FORK LIFT TRUCK

[76] Inventor: Theodore Vucinic, 5402 Ninth Ave., Countryside, Ill. 60525

[21] Appl. No.: 923,301

[22] Filed: Jul. 10, 1978

[51] Int. Cl.[3] ..... B66C 3/00

[52] U.S. Cl. ..... 414/785; 414/607

[58] Field of Search ..... 414/607, 608, 662, 663, 414/664, 665, 666, 667, 668, 669, 670, 671, 672, 785

[56] References Cited

U.S. PATENT DOCUMENTS

| | | | |
|---|---|---|---|
| 2,610,751 | 9/1952 | Bevan | 414/608 |
| 3,387,731 | 6/1968 | Gibson et al. | 414/667 X |

FOREIGN PATENT DOCUMENTS

| | | | |
|---|---|---|---|
| 1205449 | 11/1965 | Fed. Rep. of Germany | 414/785 |
| 1294848 | 11/1972 | United Kingdom | 414/607 |
| 1373646 | 11/1974 | United Kingdom | 414/607 |

*Primary Examiner*—Frank E. Werner
*Attorney, Agent, or Firm*—Norman Lettvin

[57] ABSTRACT

At attachment to the fork lift tines of a standard fork lift vehicle permits the vehicle to simultaneously engage and lift two adjacent, single width pallet stacks. The attachment includes a laterally elongated frame member for supportingly cooperating with the two adjacent pallets, a pair of channeled, L-shaped, tine-receiving members for receiving the fork lift tines, and a pair of attachment tines for doubling the pallet lifting capacity of the fork lift vehicle. When the frame member is secured to the fork lift tines, the attachment tines and the fork lift tines are located in a common plane and provide two adjacent pairs of pallet lifting tines.

5 Claims, 2 Drawing Figures

ADAPTER FOR A FORK LIFT TRUCK

FIELD OF THE INVENTION

This invention relates generally to attachments for fork lift vehicles, and more particulary, to an attachment to the fork lift tines of a fork lift vehicle which permits two adjacent, single width pallet stacks to be simultaneously lifted.

BACKGROUND OF THE INVENTION

Fork lift vehicles are commonly employed on warehouse and factory loading docks to move and store palletized loads on or from truck trailers.

Normally only a single width pallet, or stack of multiple pallets, is to be lifted by a fork lift vehicle. This is dictated by the fact that the fork lift vehicle is usually a narrow width vehicle, and in order to avoid lateral tipping, the center of gravity of the load being lifted should be located as close as possible to a vertical, medial, longitudinal plane of the vehicle.

While some U.S. Patents have disclosed attachments to fork lift vehicles, such as lateral extension plates in U.S. Pat. No. 3,023,919, or solid base plate attachments as in U.S. Pat. No. 3,283,933, or triple-tined attachments as in U.S. Pat. No. 2,675,139, or laterally extensible tines as in U.S. Pat. No. 3,754,673, none of said patents suggest lifting two side-by-side pallets, or pallet stacks, by a standard fork lift vehicle.

The unloading or loading of a trailer that has two longitudinal rows of adjacent side-by-side pallets or pallet stacks would be facilitated, at substantial cost savings, if a pair of adjacent side-by-side pallets, or pallet stacks, would be unloaded or loaded simultaneously by a single fork lift vehicle entering longitudinally of the trailer through its open rear end.

Due to the normal eight foot width of the trailers, the loads are arranged for shipment on a pair of adjacent pallets which occupy substantially the full trailer width. The loaded pallets are usually stacked atop one another so as to occupy, as near as possible, the full height of the box car or trailer. Dunnage is then added to fill in areas not occupied by the palletized load, and thereby prevent shifting of that load.

It is therefore one object of the present invention to provide an attachment for fork lift vehicles which will permit said vehicles to simultaneously unload a pair of adjacent, single width pallets.

It is a further object of the present invention to provide an attachment for fork lift trucks which is longitudinally and laterally elongated to simultaneously support a pair of stacked, single width pallets.

These, and other objects, features and advantages of the present invention will become apparent to persons ordinarily skilled in the art from a review of the following description of a preferred embodiment and the appended claims.

BRIEF SUMMARY OF THE INVENTION

An attachment, for standard fork lift vehicles which include two L-shaped lift members defining forwardly extending pallet-engaging tines and upwardly extending posts, converts the vehcile from one that can only lift a single width pallet stack to one that can lift a pair of adjacent single width pallet stacks. The attachment comprises a laterally elongated frame to supportingly cooperate with a pair of single width pallets, two L-shaped lift member-receiving means, each defined by a generally upright portion and a generally horizontal portion, and two attachment tines projecting forwardly of the frame.

The attachment is secured to the L-shaped lift members by positioning the pallet-engaging tines in a channel formed in the horizontal portion of the lift member-receiving means and by positioning the posts in a channel formed in the vertical portion of the lift member-receiving means. With the attachment secured to the vehicle, the two attachment tines and the two pallet-engaging tines are positioned so as to be substantially coplanar and the distance between any two adjacent tines is substantially equal to the width of a single pallet so as to permit the simultaneous lifting of two adjacent, single width pallets.

DETAILED DESCRIPTION OF THE INVENTION

Figure 1:
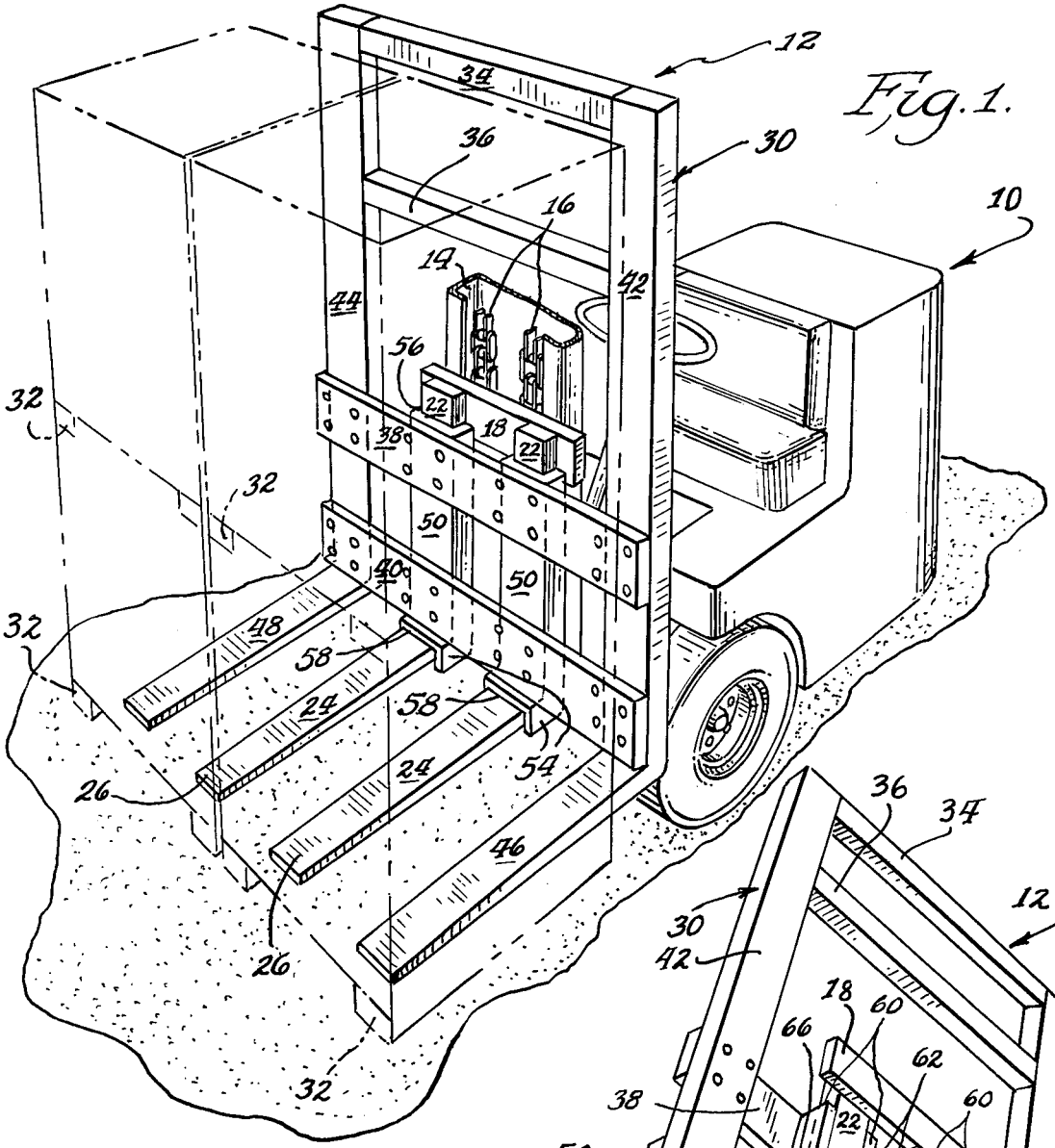
FIG. 1 is a perspective view of a standard fork lift vehicle showing the attachment of the persent invention secured thereto, and loaded with a pair of adjacent, single width pallet stacks.
Figure 2:
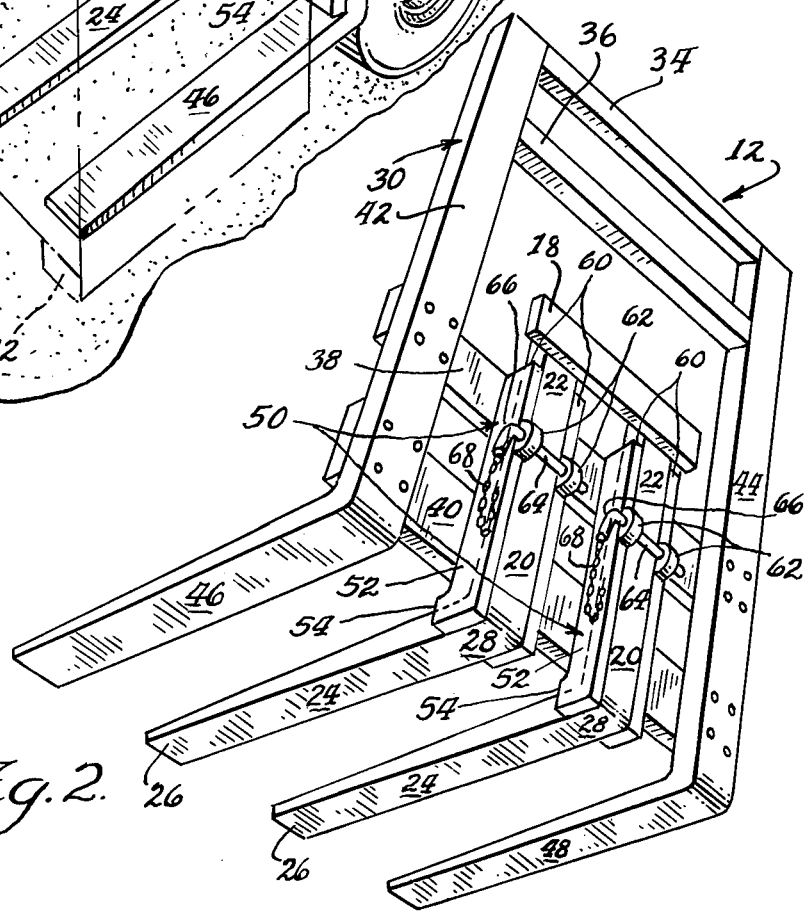
FIG. 2 is a perspective view of the fork lift attachment of FIG. 1 showing the fork lift tines bolted within the channels formed in the L-shaped lift member-receiving means.

Referring now to the drawings, FIG. 1 illustrates a standard fork lift vehicle as 10 and an attachment therefor as 12. The front or forward end of the vehicle 10 includes upright channel 14 for housing a pair of endless chain belts 16. Attached to the chain belts 16 is a flat plate 18 to which a pair of laterally spaced, L-shaped lift members 20 are rigidly secured. Each L-shaped lift member includes an upwardly extending post 22 and a forwardly extending, pallet-engaging tine 24 defined by a distal toe end 26 and a root end 28. As is standard design in the art, the thickness of the tines 24 increases from the toe end 26 to the root end 28. The details of construction and operation of the parts just described are well known and need not be further described herein. It should, however, be understood that other suitable elevating means may be employed with the attachment 12 of the present invention.

The attachment 12 includes a frame 30 of a lateral width sufficient to support two adjacent, single width pallets 32 and of a height sufficient to support two stacked and loaded pallets 32. The frame 30 comprises a generally rectangular assembly having a number of transverse beams such as 34, 36, 38, 40 formed with or otherwise connecting a pair of spaced, vertically extending beams 42 and 44. The number of transverse or vertical beams shown in the drawings are illustrative only and may vary with the weight of the load the attachment 12 normally supports.

A pair of generally horizontal, forwardly projecting tines 46 and 48 are integrally formed with, or otherwise rigidly supported by the vertical beams 42 and 44. The width, length, and taper of the attachment tines 46 and 48 correspond to the length, width and taper of the fork lift tines 24 so as to provide four similarly configured tines for pallet manipulation.

Attachment means are also provided on frame 30 for selective connection of that frame to the L-shaped lift members 20 of the fork lift truck 10. The attachment means include a pair of spaced, generally L-shaped, lift member-receiving means 50 defined by a generally upright portion 52 and a generally horizontal portion 54. The L-shaped lift member-receiving means 50 are centrally recessed to provide elongated vertical channels 56 in the upright portions 52 and elongated horizontal channels 58 in the horizontal portions 54. The width of the channels 56 and 58 correspond to the width of the L-shaped lift members 50 so as to be adapted for receiving the L-shaped lift members 50 therein.

A pair of shoulders 60 form the opposite side portions of the vertical channels 56 formed in the upright and horizontal portions 52 and 54 of the L-shaped lift-receiving means 50. On each of the shoulders 60 an apertured flange 62 may be integrally formed, or otherwise attached. A slide bolt 64 having an angled handle 66 is fastened by a chain 68 to the L-shaped lift-receiving means 50. A second flange and bolt may be provided for additional support if necessitated by the weight of the loaded pallets.

In operation, the fork lift vehicle 10 is maneuvered into close proximity to the attachment 12. The attachment 12 may then be seated on the L-shaped lift members 20 such that the horizontal portions 54 of the lift member-receiving means 50 are supportingly received by the root portions 28 of the fork lift tines 24 and the vertical portions 52 of the lift member-receiving means 50 are embraced by the upwardly extending posts 22 of the lift member-receiving means 50. The slide bolts 64 are slid through the apertured flanges 62 to prevent forward movement of the attachment 12 relative to the fork lift vehicle 10, while the weight of the loaded pallets serves to prevent upward movement of the attachment 12 relative to the vehicle 10 and firmly seat the root portions 28 of the fork lift tines 24 in the channel 58 formed in the horizontal portions 54 of the L-shaped lift member-receiving means 50.

With the attachment 12 rigidly secured to the fork lift vehicle 10, the fork lift tines 24 and the attachment tines 46 and 48 are substantially coplanar and extend forward of the vehicle 10 substantially equal distances. Further, the adjacent tines, 46, 24, 24, and 48, are spaced laterally of each other by substantially equal distances. The distances between any two adjacent tines, 24, 46 or 48, are slightly less than the width of a single width pallet 32 so as to permit single pallet stacks to be simultaneously balanced and lifted by tines 24–46 and by tines 24–48.

While one form of the invention has been described, it will be understood that the invention may be utilized in other forms and environments, so that the purpose of the appended claims is to cover all such forms of devices not disclosed but which embody the invention disclosed herein.

What I claim is:

1. An attachment, for standard fork lift vehicles that include a pair of L-shaped lift members that provide forwardly extending pallet-engaging tines, each pallet-engaging tine having a distal toe portion and a root portion, and upwardly extending posts, for converting the vehicle from one that can only lift a single width pallet stack, said attachment comprising, in combination:

laterally elongated frame means of a lateral width to supportingly cooperate with a pair of adjacent single width pallets;

attachment means on said frame means for selective connection of said frame means to said pair of L-shaped lift members by supporting engagement of said frame means on the root portions of said pallet-engaging tines and by embracing portions of said upwardly extending posts; and said frame means including two forwardly projecting tines, each of said tines spaced laterally outward from said pallet-engaging tines and positioned so as to be located substantially in the plane of said pallet-engaging tines to which the frame means are to connect, whereby two adjacent pairs of pallet-lifting tine means are provided, said pairs of tine means permitting the vehicle to be selectively used to simultaneously lift two adjacent single width pallet stacks.

2. An attachment as in claim 1 wherein the attachment means includes a pair of generally L-shaped lift member-receiving means, each lift member-receiving means defined by a generally upright portion and a generally horizontal portion, a channel formed in the upright and horizontal portions of the L-shaped, tine-receiving means, the channel being of a width corresponding to the width of the lift members so as to receive the lift members therein.

3. An attachment as in claim 2 further including means for rigidly securing the frame means to the pair of L-shaped lift members.

4. An attachment as in claim 1 wherein the tine means are equally spaced with the distance between two adjacent tine means substantially equal to the width of a single width pallet stack so as to permit the simultaneous lifting and carrying of two adjacent single width pallets.

5. An attachment as in claim 1 wherein the frame means is of a longitudinal height to supportingly accommodate at least a pair of stacked pallets.

* * * * *